US005551788A

United States Patent [19]

Wacha et al.

[11] Patent Number: 5,551,788

[45] Date of Patent: Sep. 3, 1996

[54] WRITING INSTRUMENT

[76] Inventors: Martin E. Wacha, 1728 Arrowhead Dr., Beloit, Wis. 53511; Evan K. Pennell, 8 Daniels St., Arlington, Mass. 02174

[21] Appl. No.: 358,051

[22] Filed: Dec. 16, 1994

Related U.S. Application Data

[63] Continuation-in-part of Ser. No. 187,760, Jan. 27, 1994, abandoned.

[51] Int. Cl.[6] ..... B43K 7/12; B43K 24/06

[52] U.S. Cl. ..... 401/116; 401/109; 401/110

[58] Field of Search ..... 401/116, 99, 109, 401/110, 111, 112

[56] References Cited

U.S. PATENT DOCUMENTS

| | | | |
|---|---|---|---|
| 3,205,864 | 9/1965 | Young . | |
| 3,436,160 | 4/1969 | Lanoie | 401/116 |
| 5,342,135 | 8/1994 | Tucker | 401/116 |

FOREIGN PATENT DOCUMENTS

| | | | |
|---|---|---|---|
| 976412 | 3/1951 | France . | |
| 1004813 | 4/1952 | France . | |
| 1963022 | 5/1981 | Germany | 401/116 |

*Primary Examiner*—Steven A. Bratlie
*Attorney, Agent, or Firm*—Paul I. Douglas

[57] ABSTRACT

A writing instrument with an advance-retract mechanism is operable by rotation of a knob opposite the writing tip. The knob rotates a shaft disposed in, and extending rearwardly from, the instrument body to advance and retract the writing tip when rotated. A retainer member has a first cylindrical portion with a plurality of inwardly extending tangs into which the shaft is received and a larger cylindrical portion having a surface directed toward the instrument body.

5 Claims, 8 Drawing Sheets

WRITING INSTRUMENT

This is a continuation-in-part of application Ser. No. 08/187,760, filed Jan. 27, 1994 now abandoned.

BACKGROUND OF THE INVENTION

The present invention relates to writing instruments in general, and more particularly to a writing instrument having a mechanism for advancing and retracting the writing tip of the instrument wherein the mechanism is actuated by rotation of a knob disposed at the non-writing end of the pen barrel.

Various writing instruments such as pencils or ball point pens are known in the art wherein the writing tip is advanced or retracted relative to the barrel by means of rotating or pushing the external element on the barrel of the instrument. Typical of such advance-retract devices are to be found in U.S. Pat. No. 3,679,318, issued Jul. 25, 1972, to Thomas A. Liguori; U.S. Pat. No. 4,290,706, issued Sep. 22, 1981, to Tatsuo Ariga; U.S. Pat. No. 4,786,197, issued Nov. 22, 1988, to Harold E. Koeln et al.; French patent 1004813, published Apr. 3, 1952, in the name of Poursier; and British patent specification 934160, published Aug. 14, 1963, in the name of Ronald Hare. These, as well as other devices have been disclosed, and many mechanisms of this type have been produced, and have met with commercial success.

One such device is disclosed in co-pending U.S. patent application Ser. No. 08/107,519, filed Aug. 17, 1993, in the name of William B. Tucker, and assigned to The Gillette Company now U.S. Pat. No. 5,342,135. In that application, a writing instrument is provided that includes an advance-retract mechanism serving to project the writing tip from within the barrel for employment of the writing instrument, and to retract the tip to a point within the barrel when the writing instrument is not in use. A plunger assembly includes a rotatable knob which is disposed at the rear of the barrel and is interconnected to a finger which contacts a cam surface of a slidable actuator. Rotation of the knob in one direction advances the writing tip from within the barrel, and opposite rotation of the knob is effective to retract the writing tip into the barrel.

While the structure disclosed in the above-referenced application has proved successful in accomplishing its various objectives, it is considered that improvement of the knob attachment to the shaft of the plunger assembly may be accomplished by more firmly fixing the connection between the rotating knob assembly to the rotating shaft of the plunger assembly, while increasing the ease of rotation of the knob during the actuating process.

It is therefore an object of the present invention to provide a writing instrument of the type described wherein the rotatable shaft portion of the actuating mechanism which extends into the rotatable knob is more firmly affixed to the knob while further providing a more easily rotatable knob for actuating the mechanism.

A further object of the invention is to provide a retainer and bearing assembly which is mounted at the rear of the writing instrument barrel and is effective to firmly affix the shaft of the advance-retract mechanism onto the barrel while providing for ease of rotation of the actuating knob.

A further object of the invention is to provide, in an alternative embodiment, a retainer which is mounted at the rear of the writing instrument barrel and is effective to firmly affix the shaft of the advance retract mechanism onto the barrel while providing for ease of rotation of the actuating knob, without the use of a bearing assembly.

SUMMARY OF THE INVENTION

The above objects and other objectives which will become apparent as the description proceeds are accomplished by providing a writing instrument having a barrel and an advance-retract mechanism actuated by rotation of a knob disposed at the rear of the instrument barrel opposite the writing tip. The shaft extends rearwardly from within the barrel to receive the knob for rotation of said shaft, the shaft being effective to advance and retract the writing tip when so rotated. A retainer member having a first cylindrical portion enveloping the shaft and a plurality of rearwardly inwardly extending tangs contacts the surface of the shaft. The retainer member has a second cylindrical portion disposed forwardly of the retainer first cylindrical portion which has a forward facing surface in spaced relation with a rearwardly facing end surface of the barrel. Biasing means is provided to force the retainer member rearwardly, and is disposed between the second cylindrical portion forward facing surface and the rear surface of the barrel. The biasing means is effective to force the tangs into the shaft and also provides a bearing surface between the retainer member and the barrel.

The biasing means disclosed herein comprises a unitary bearing member, the bearing member having a cylindrical body through which the shaft extends and having a surface contacting the end surface of the barrel. A radially outwardly extending flange is disposed on the bearing member for contacting the forward facing surface of the retainer member.

The unitary bearing member is generally formed of a resilient plastic material and the radially outwardly extending flange is compressible between the end surfaces of the barrel and the forward facing surface of the retainer member, causing the biasing action to force the tangs into the shaft. The shaft is generally formed of plastic and the retainer member is formed of a metallic material to provide the locking action between the retainer and the shaft when the metallic tangs are forced into the plastic shaft.

In an alternative embodiment the biasing means maybe deleted from the apparatus, thereby eliminating one piece from and simplifying the assembly process.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
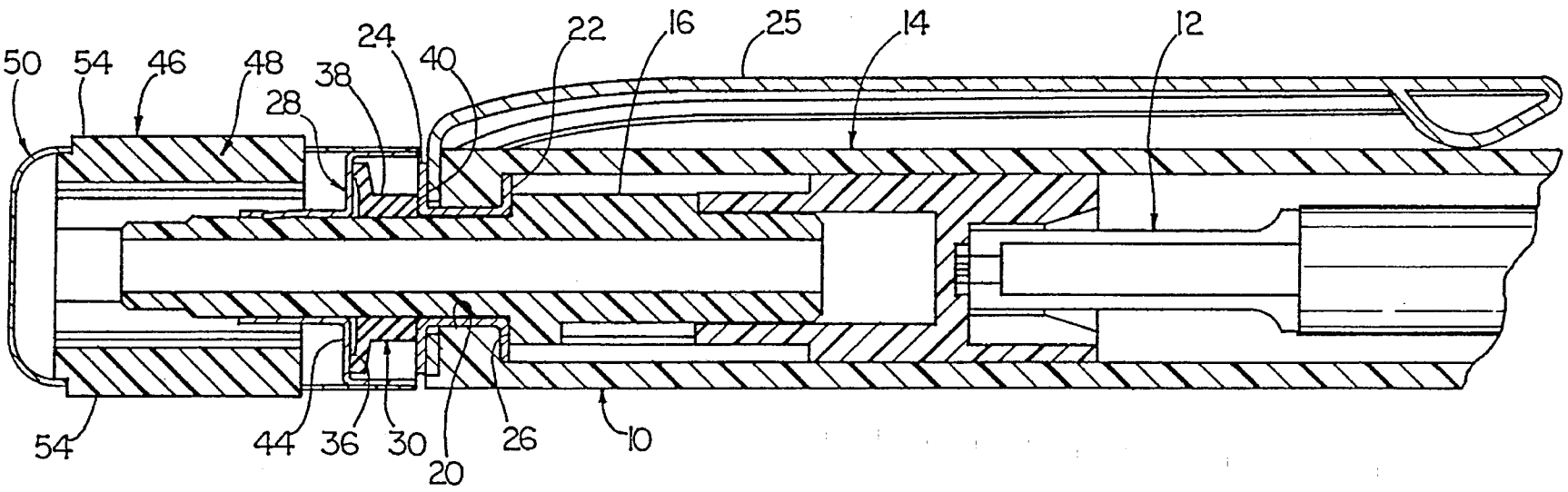
FIG. 1 is a sectional elevational view showing a portion of a writing instrument constructed in accordance with the teachings of the present invention.

Referring now to the drawing, and particularly to FIG. 1 there is shown a writing instrument 10 in the form of a ball point pen having an elongated writing assembly 12 disposed in a barrel 14. The various elements and the function of the writing assembly 12 are disclosed in the aforementioned U.S. Pat. No. 5,342,135, and therefore will not be explained in detail in the present disclosure. It should however be understood, that the present invention is not limited to those elements of the writing assembly as shown, but may be employed with any of a number of writing assemblies which are actuated by rotation of a shaft carrying external knob, or other device.

Figure 2:
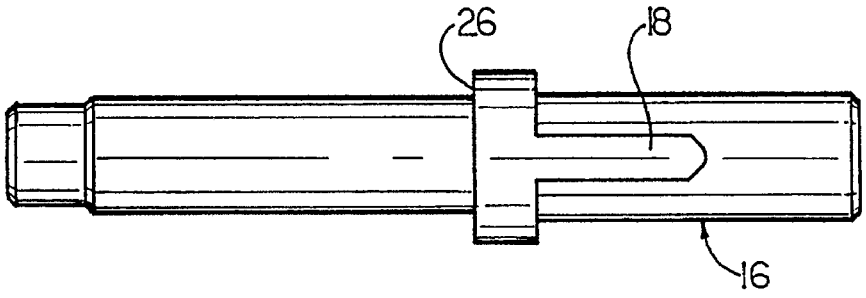
FIG. 2 is an elevational view showing the actuator shaft employed in the writing instrument of FIG. 1.

As shown and described in the aforementioned Tucker Patent, the actuating member comprises a shaft 16 as shown in FIG. 2, having a portion extending into the barrel 14, and a portion extending through an opening in the barrel for access by the user to rotate the shaft and thereby cause a finger 18 to manipulate those elements of the writing assembly 12, and move the writing tip into and out of the barrel 14.

Figure 3:
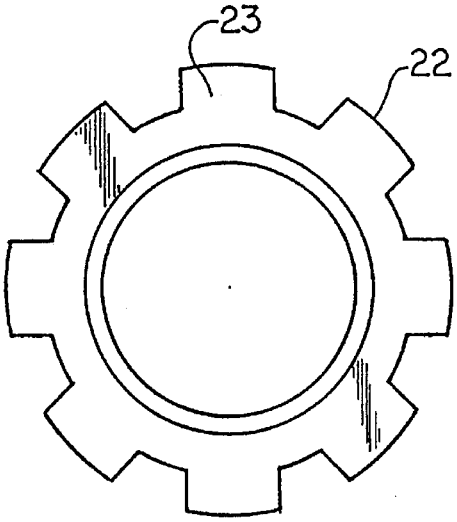
FIG. 3 is an end elevational view showing the retaining rivet employed in the structure of FIG. 1.
Figure 4:
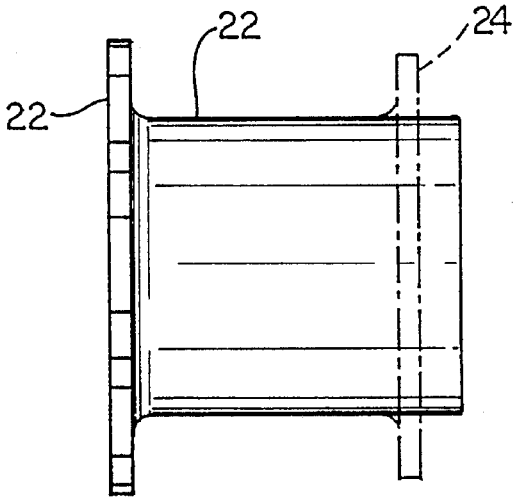
FIG. 4 is a side elevational view showing the rivet of FIG. 3, the dot-dash lines indicating that portion of the rivet which has been set, as in FIG. 1.

Referring still to FIG. 1, taken with FIGS. 2 through 4, the barrel 14 has an opening 20 through which the shaft 16 extends, and a rivet 22 extends into the opening 20 having a planar surface 23 and a portion 24 which is peened over to encapsulate a clip 25. As best shown in FIG. 1, the shaft 16 extends outwardly through the opening 20 to a point at which a shoulder 26 of the shaft contacts the surface 22 of the rivet.

While the interface of the shoulder 26 of the shaft 16 with the peened portion 24 of the rivet is effective to retain the shaft from rearward movement, it is necessary to provide means for clamping the shaft in place such that it is held from movement either forwardly, or rearwardly, and yet is allowed to rotate freely for actuation of the writing assembly 12.

Referring now to FIGS. 5 through 10 there is shown a novel retainer 28 and bearing 30 which combine to achieve both the clamping action, and produce the ease of rotation desired in the assembly.

Figure 5:
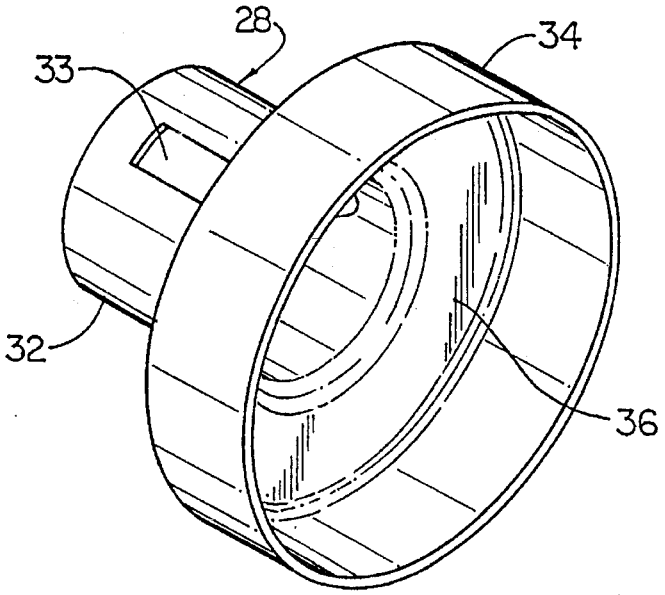
FIG. 5 is an elevational perspective view showing the retainer member employed in the structure of FIG. 1.
Figure 7:
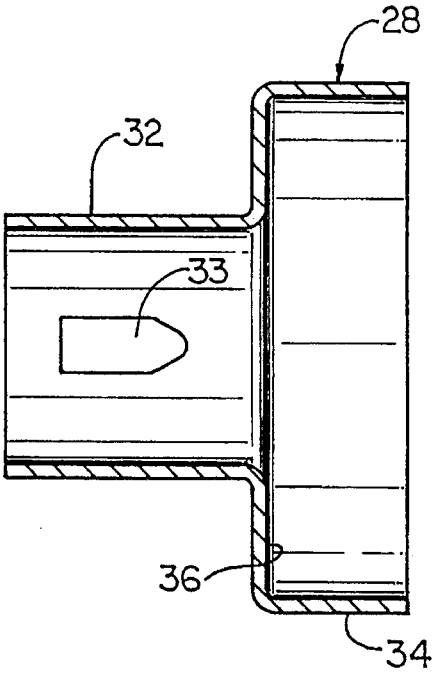
FIG. 7 is an elevational sectional view taken along the line VII—VII of FIG. 6 showing further details of the structure of FIGS. 5 and 6.
Figure 6:
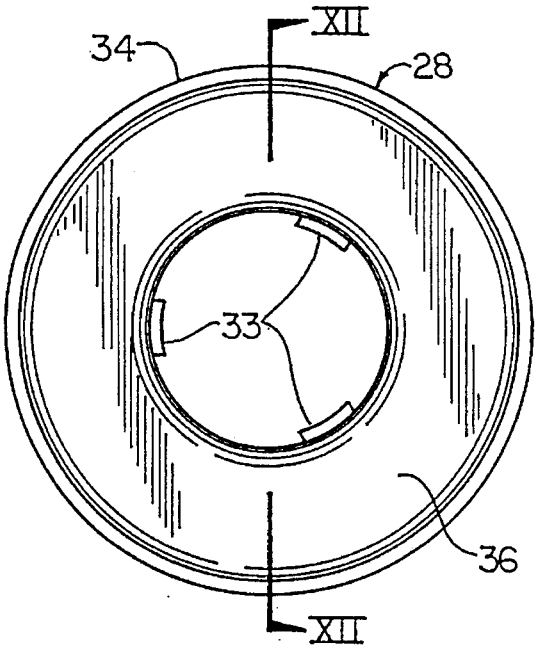
FIG. 6 is an end elevational view showing details of the retainer member of FIG. 5.

Referring particularly to FIGS. 5, 6 and 7 taken in conjunction with FIG. 1 the retainer 28 is shown to comprise a first cylindrical portion 32 which is of a size to substantially envelope the shaft 16 when inserted therein, and three inwardly extending tangs 33 which project inwardly to contact the shaft in interfitting engagement with the outer surface of the shaft. A second cylindrical portion 34, of larger diameter than the cylindrical portion 32, is disposed forwardly of the portion 32 and comprises a forward facing surface 36 with the retainer mounted as shown in FIG. 1, the surface 36 being disposed in spaced relation with the barrel 14 which has the rivet 22 set in place. It is well to note that the cylindrical portion 34 substantially forms a cup for retaining the bearing 30, however the forward edge of the retainer cylindrical portion 34 lies outside of the peened portion 24 of the rivet, thereby allowing only the bearing 30 to provide rotatable surfaces between the barrel 14 and the surface 36 of the retainer 28.

Figure 8:
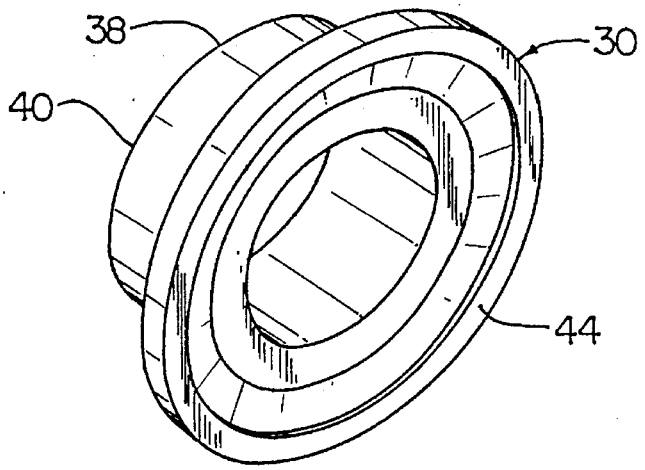
FIG. 8 is an elevational perspective view showing the bearing member employed in the structure of FIG. 1.
Figure 9:
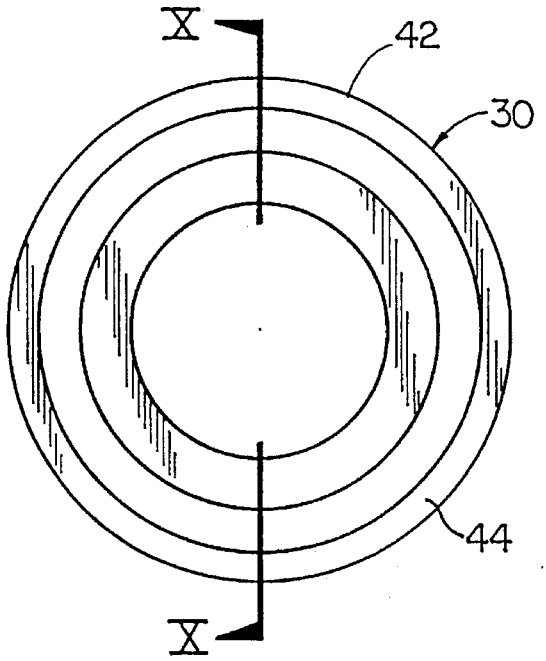
FIG. 9 is an end elevational view showing details of the structure of FIG. 8.
Figure 10:
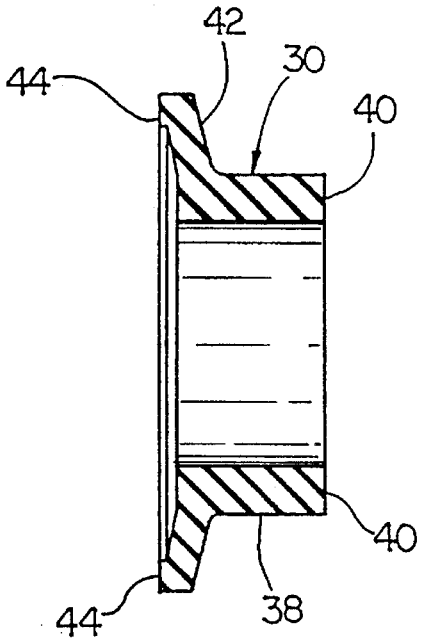
FIG. 10 is an elevational sectional view taken along the line X—X of FIG. 9 showing further details of the structure of FIGS. 8 and 9.
Figure 11:
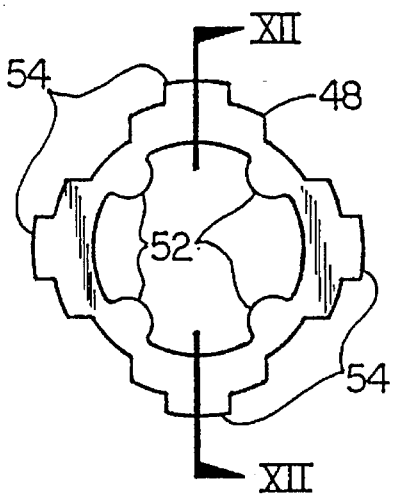
FIG. 11 is an elevational end view showing the sleeve member employed in the construction of FIG. 1.
Figure 12:
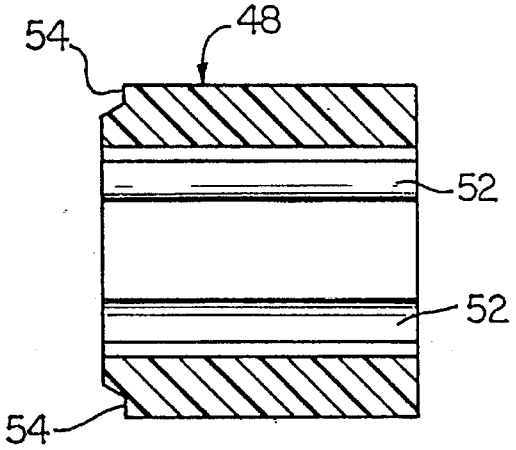
FIG. 12 is an elevational sectional view taken along the line XII—XII of FIG. 11 showing details of the structure of FIG. 11.
Figure 13:
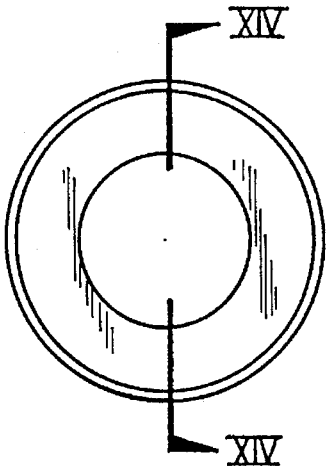
FIG. 13 is an end elevational view showing the cap member of FIG. 1.

With reference to FIGS. 8 through 10 the bearing 30 is of unitary construction and comprises a cylindrical body 38 through which the shaft 16 extends and a planar surface 40 which contacts the barrel 14 at the portion 24 of the rivet 22. A radially outwardly extending flange 42 is provided with a planar bearing surface 44 for contacting the forward facing surface 36 of the retainer 28. It will further be noted that the flange 42, in addition to extending radially outwardly, is canted rearwardly to in effect form a spring-like or biasing effect when compressed between the surface 36 of the retainer 28 and the barrel 14.

In the construction of FIG. 1, both the shaft 16 and the bearing 30 are manufactured of a resilient plastic material such as acetal. The retainer 28 is manufactured of a metallic material such as brass or the like, to provide tangs 33 which will pierce and enter the surface of the shaft 16 when forced rearwardly by the biasing action of the flange 42 of the bearing 30.

Figure 14:
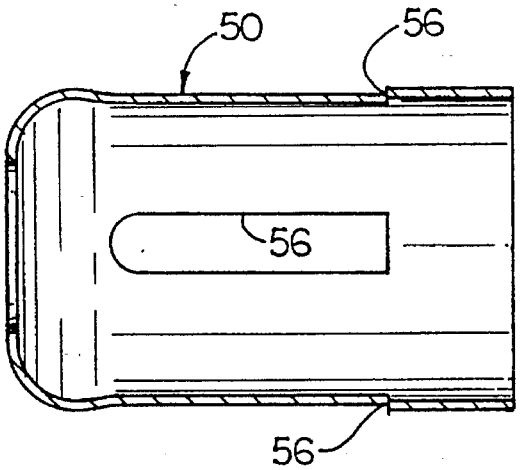
FIG. 14 is an elevational sectional view taken along the line XIV—XIV of FIG. 13 showing details of the cap member.
Figure 15:
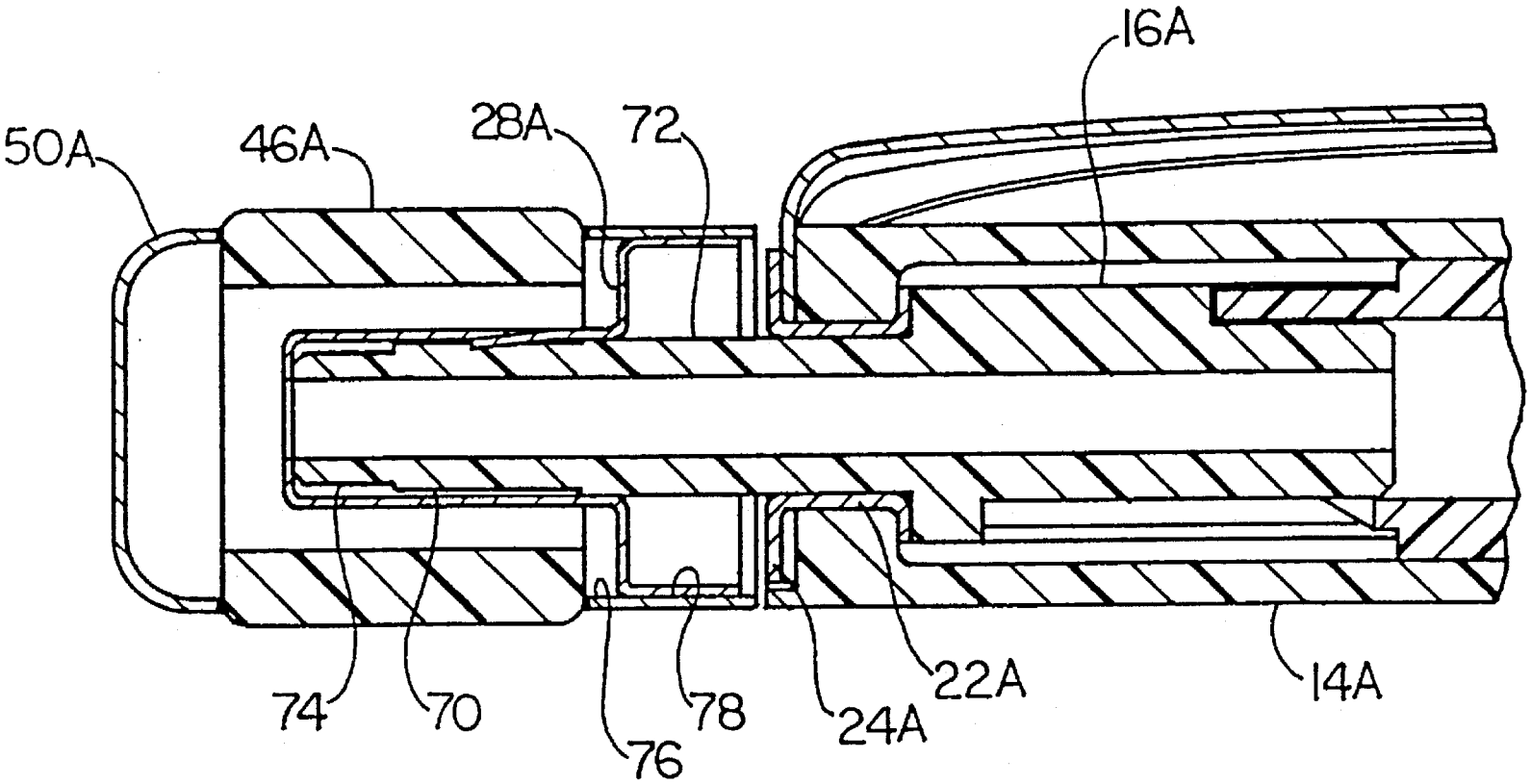
FIG. 15 is a sectional elevational view of the alternative embodiment showing a portion of a writing instrument constructed in accordance with the teachings of the present invention, wherein the biasing member is deleted from the assembly.
Figure 16:
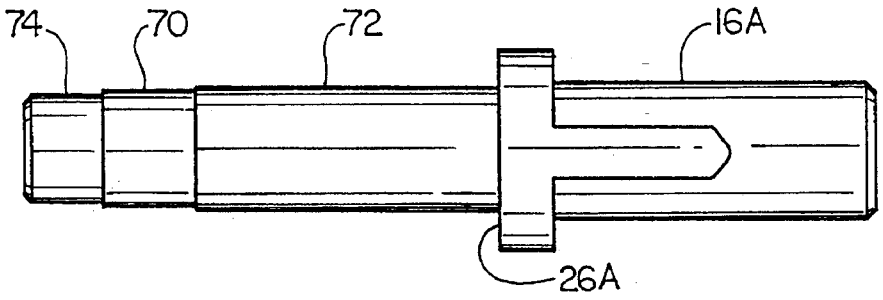
FIG. 16 is an elevational view showing the actuator shaft employed in the writing instrument of FIG. 15.
Figure 17:
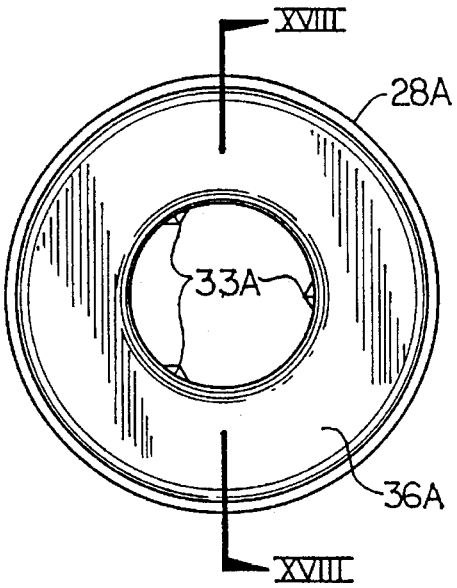
FIG. 17 is an elevational perspective view showing the retainer member employed in the structure of FIG. 15.

Referring now to FIG. 1 taken in conjunction with FIGS. 11 through 14 a knob 46 is provided at the rearwardmost end of the shaft 16 for rotation of the shaft to actuate the writing assembly 12. The elements of the knob 46 comprise a sleeve 48 and cap 50 the sleeve 48 being manufactured of a resilient plastic material and the cap 50 being formed of a metallic material. The sleeve 48 is provided with 4 inwardly directed projections 52 having arcuate surfaces which are spaced to provide an engagement with the rearwardmost end of the shaft 16. The sleeve 48 further has four outwardly projecting blocks 54 which extend outwardly from the body of the sleeve 48. As best shown in FIG. 14 the cap 50 is a tubular member and has four slots 56 formed therein and positioned to receive the blocks 54 therein, the cap aiding to retain the resilient sleeve 48 into interfitting engagement with the shaft 16 when the cap is in place.

In an alternative embodiment of the invention the biasing member i.e. bearing 30 is eliminated. Referring now to FIGS. 15–19, elimination of the bearing 30 (FIG. 1 ) eases the assembly operation of the cap 50A, knob 46A and retainer 28A onto the shaft 16A. Since the bearing 30 has been eliminated, such that there is no longer an imposed force acting from the tang 33A to the shaft 16A, the tangs 33A are redesigned to engage the shaft in a more aggressive manner. Comparing the original tang design (FIG. 5, FIG. 7) with the revised tang design (FIG. 18 and FIG. 19) it can be seen that the new tang 33A includes a chevron side A 82 and a chevron side B 84 which merge at a chevron side A, B junction 86. The chevron's 82, 84 are forced sufficiently downward from the surface of the first cylindrical portion 32A of the retainer 28A, such that a definite tang opening 88 is formed between the exterior and interior surfaces of the retainer 28A.

The retainer 28A, as before includes the forward facing surface 36A, the retainer second cylindrical portion outer surface 78, and the second cylindrical portion 34A.

The shaft 16A as before includes a shoulder 26A and a main shaft shoulder 72, but also includes tang shoulder 70, and centralizer shoulder 74. The centralizer shoulder 74 is of smaller outer diameter than the tang shoulder 70, the tang shoulder 70 being of smaller outer diameter than the main shaft shoulder 72. The outer diameters of the shoulder 74, and 70 are selected such that the retainer 28A may first be centralized relative to the shaft 16A during assembly over the shaft 16A. As the assembly progresses, the tangs 33A drag over and securely engage with the tang shoulder 70, preventing the cap from being withdrawn from the shaft. The tang shoulder 70 in one embodiment has an outer diameter slightly less than the adjacent main shaft shoulder 72. It should be well understood that the tang shoulder, depending on the design of the tangs, may have an outer diameter equal to, or even greater than the main shoulder 72.

Figure 18:
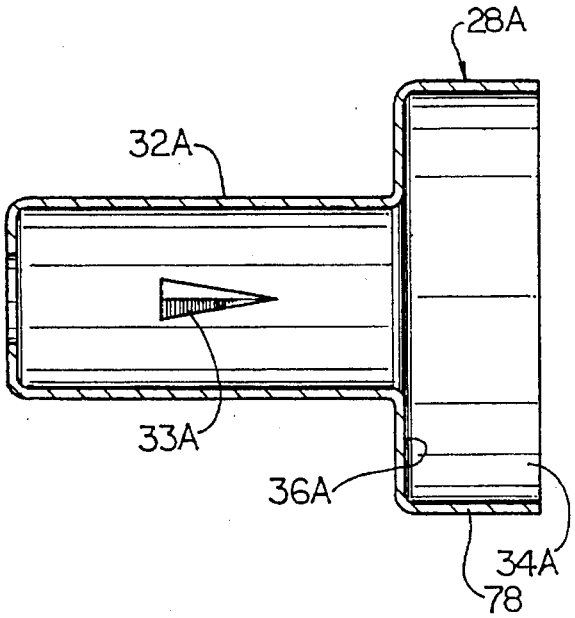
FIG. 18 is an elevational sectional view taken along lines XVII—XVII of FIG. 17, showing further details of the structure of FIG. 17.
Figure 19:
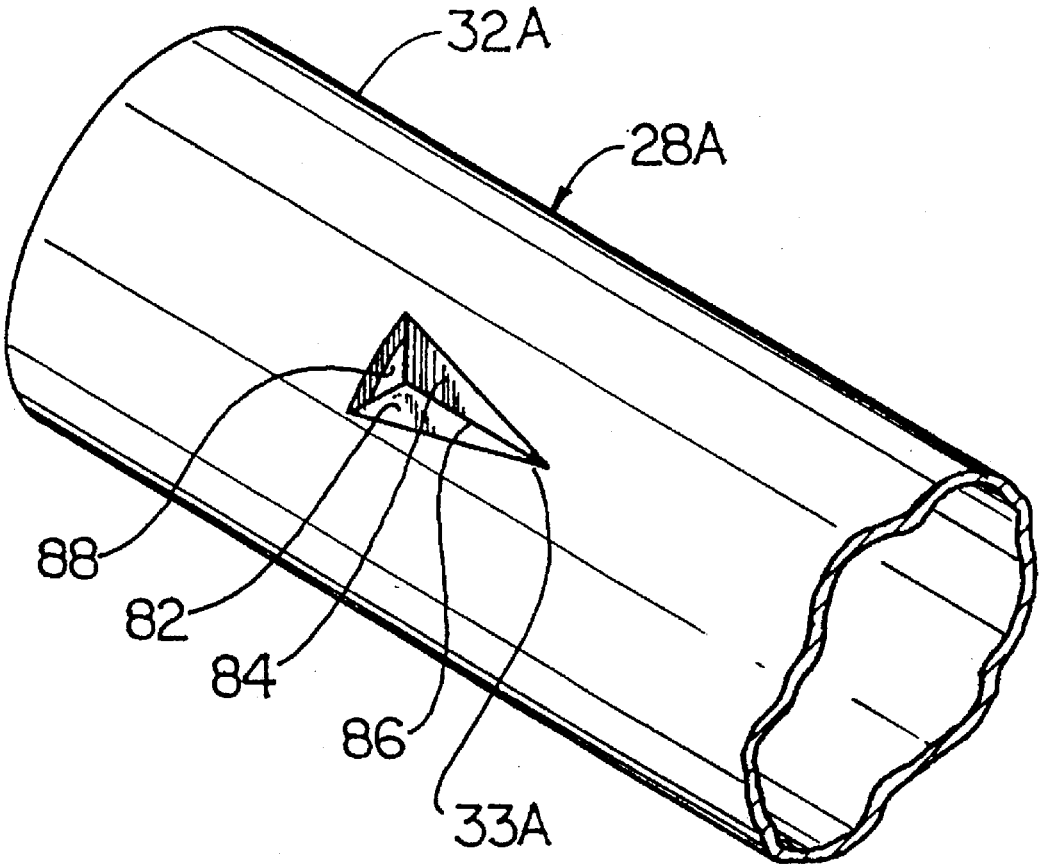
FIG. 19 is an isometric elevational view showing details of the alternative embodiment tang structure formed on the retainer.

Additionally, though the tangs are shown in FIG. 18 located centrally from either end of the first cylindrical portion, they may be located toward either end of the first cylindrical portion, so as to cooperate with the tang shoulder 70.

As can be seen from the new FIGS. 15–19, the second cylindrical portion outer surface 78 engages in an interference fit with the cap inner surface 76. The engagement force of the cap inner surface with the second cylindrical portion outer surface is designed to exceed the engagement force of the tangs with the centralizer shoulder and the tang shoulder, such that the cap remains fixed relative to the retainer when the tangs are engaged with the tang shoulder. In other words, during assembly, the knob 46A is first inserted into openings in cap 50A, and the retainer 28A is thereafter inserted into the cap 50A. The retainer 28A remains fixed relative to the cap 50A, by strong interference fit, even while the tangs are dragged upwardly over the centralizer shoulder and the tang shoulder.

The selection of tang geometry, tang shoulder and centralizer shoulder dimensions, and the strength of the interference fit between the retainer 28A and cap 50A are such to create a strongly secured cap, retainer and knob system on the end of the shaft 16A.

As can be seen from the drawings, inward motion of the shaft is prevented by the cap striking the end of the pen barrel 14A.

While it is apparent that changes and modifications can be made within the spirit and scope of the present invention, it is our intention, however, only to be limited by the appended claims.

I claim as my invention:

1. A writing instrument having a barrel and an advance-retract mechanism actuated by rotation of a knob disposed at the rear of the instrument barrel opposite the writing tip, comprising:

a shaft extending rearwardly from within said barrel to receive a knob for rotation of said shaft, and said shaft being effective to advance and retract said writing tip when so rotated; and a retainer member having a first cylindrical portion enveloping said shaft and having a plurality of rearwardly inwardly extending tangs contacting the surface of said shaft; said retainer member having a second cylindrical portion disposed forwardly of said retainer first cylindrical portion and having a forward facing surface in spaced relation with a rearwardly facing end surface of said barrel.

2. The writing instrument of claim 1 wherein said shaft is formed of a plastic material and said retainer member is formed of a metallic material.

3. The writing instrument of claim 1 wherein said retainer member second cylindrical portion further comprise wall structure extending substantially from said forward facing surface to form a forwardly facing cup.

4. The writing instrument of claim 1 wherein said retainer member includes a second cylindrical potion outer surface, and said cap includes a cap inner surface, wherein said second cylindrical portion outer surface engages in an interference fit with said cap inner surface.

5. The writing instrument of claim 4 wherein said shaft includes a centralizer shoulder and an adjacent tang shoulder located on the distal end of said shaft, and wherein the engagement force of said cap inner surface with said second cylindrical potion outer surface exceeds the engagement force of said tangs with said centralizer shoulder and said tang shoulder, such that said cap remains fixed relative to said retainer member when said tangs are engaged with said tang shoulder.

* * * * *